US005950966A

United States Patent [19]

Hungate et al.

[11] Patent Number: 5,950,966

[45] Date of Patent: Sep. 14, 1999

[54] DISTRIBUTED POSITIVE TRAIN CONTROL SYSTEM

[75] Inventors: Joe Bryan Hungate; Stephen Robert Montgomery, both of Marion, Iowa

[73] Assignee: Westinghouse Airbrake Company, Wilmerding, Pa.

[21] Appl. No.: 08/932,188

[22] Filed: Sep. 17, 1997

[51] Int. Cl.[6] ..... B61L 1/00

[52] U.S. Cl. ..... 246/62; 246/167 R; 246/182 R

[58] Field of Search ..... 246/3, 4, 14, 62, 246/72, 122 R, 167 R, 176, 177, 182 R, 182 B, 182 C, 186

[56] References Cited

U.S. PATENT DOCUMENTS

| | | | |
|---|---|---|---|
| 3,740,548 | 6/1973 | Hoyler | 246/3 |
| 5,129,605 | 7/1992 | Burns et al. | 246/5 |
| 5,332,180 | 7/1994 | Peterson et al. | 246/3 |
| 5,364,047 | 11/1994 | Petit et al. | 246/182 R |
| 5,398,894 | 3/1995 | Pascoe | 246/62 |
| 5,415,369 | 5/1995 | Hungate | 246/167 R |
| 5,452,870 | 9/1995 | Heggestad | 246/182 R |
| 5,474,267 | 12/1995 | Kubota et al. | 246/182 R |
| 5,487,516 | 1/1996 | Murata et al. | 246/182 C |
| 5,533,695 | 7/1996 | Heggestad et al. | 246/182 R |
| 5,823,481 | 10/1998 | Gottschlich | 246/62 |

*Primary Examiner*—Mark T. Le
*Attorney, Agent, or Firm*—Whitham, Curtis & Whitham

[57] ABSTRACT

A system for controlling train movement uses a distributed architecture. Wayside controllers receive signals from individual trains, including position information derived from a navigation system. The wayside controllers interface with a central train control network, and coordinate local train movement including the issuance of incremental authorities.

32 Claims, 4 Drawing Sheets

DISTRIBUTED POSITIVE TRAIN CONTROL SYSTEM

BACKGROUND

The present invention relates to a distributed system and method for controlling train movement in a track network.

Train movement control is a complicated activity even with computer support. The trains must be directed to the correct destinations within a tight time schedule, and the physical limitations of the track network impose substantial contraints on train movement. Obviously, two trains travelling on the same track cannot pass each other in opposite directions or in the same direction, except where sidings occur. Safety considerations limit how closely trains may approach each other and at what speeds they may travel at different points in the track network. The length of a single train and its weight and weight distribution may vary as the train travels from destination to destination. These factors affect braking distances and determination of which sidings are long enough to accommodate the train.

This activity usually is coordinated offboard the trains, and movement authority is communicated to each train by signal aspect information from wayside logic in signaled territory and by radio communications in non-signaled territory. Such coordination requires information about the location of each train. Such information can be available from estimations, from voice communications, and from track sensors. Current concepts exist to determine train positions using navigation systems such as the Global Positioning System (GPS).

GPS is an example of a current navigation system in which numerous signals are transmitted from points which are known or ascertainable by the receiver. By tracking signals from such a system, a receiver may be able to derive information such as its position, direction, or velocity. Of course, a train will follow the railroad track, but it will be useful to acquire very accurate position information from a navigation system.

Disadvantages of current train control concepts include requirements for elaborate train dispatching offices and highly detailed onboard train data bases. These undesirable requirements would dramatically increase the cost of positive train control and reduce the likelihood of eventual implementation.

For example, current concepts would require major modification or complete redesign and replacement of train dispatching office computing systems. This would be very expensive, would require additional training for dispatchers, would increase the susceptibility for the introduction of errors into the system, and would increase human stress during the transition between two dispatching office systems.

Current concepts also would require highly detailed onboard train data bases. This would create a logistics problem in maintaining an up-to-date configuration of the data base on the highly mobile trains. It also would place additional operational requirements on the system to handle non-equipped trains or trains with failed equipment.

The present invention for controlling train movement uses a distributed architecture. In one embodiment, wayside controllers receive signals from individual trains, including position information which can be derived from a navigation system. The wayside controllers interface with a central train control network and coordinate local train movement. A designated section of the track network is assigned to each wayside controller, and that controller can issue incremental movement authority to a train within that designated section of the track network.

In some embodiments, the central train control network may issue movement authority for a relatively large section of track, and a wayside controller automatically partitions that authority into increments. The wayside controller may then transmit the incremental movement authority to the train at the appropriate times. For example, an incremental movement authority might not be executed until satisfaction of a condition, or until after the elimination of any local conflicts.

In some embodiments, the designated section of the track network could be divided into blocks, and the wayside controller could contain a data base of definitions of those blocks. The incremental movement authority transmitted to a train could comprise permission to move to an end of a specific block at a speed not exceeding a specific limit.

Embodiments of the present invention of a distributed train control system can be simpler and more cost effective than the current concepts for a centralized system. The present invention can be implemented to accommodate monitored manual switches or remote powered switches, it does not require an onboard train data base, and does not require major modifications or replacement of existing dispatching office equipment. The present invention may be implemented in non-signaled territory and in signaled territory. Ambiguity for the dispatcher or for the train engineer can be minimized, since they can interact with the system in the same way, regardless of whether there is non-signaled territory movement authority (MA), centralized traffic control (CTC) in signaled territory, or automatic incremental movement authority. Operation can be as it is today for non-equipped trains or for trains with failed equipment.

The features of the present invention which are believed to be novel are set forth below with particularity in the appended claims. The invention, together with further advantages thereof, may be understood by reference to the following description in conjunction with the accompanying drawings, which illustrate specific embodiments of the invention.

DETAILED DESCRIPTION OF THE INVENTION

Figure 1:
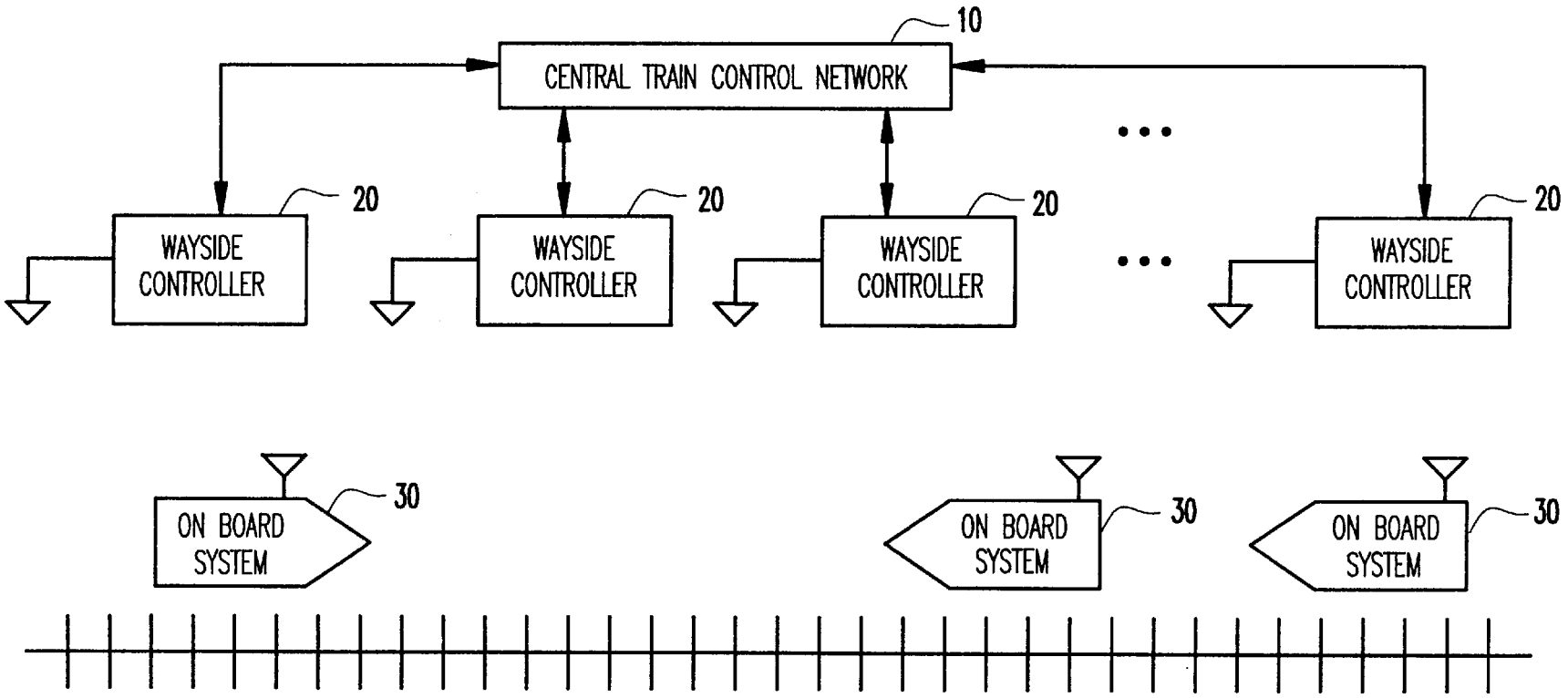
FIG. 1 is a block diagram of an overview of one embodiment of the invention.

FIG. 1 is a block diagram of an overview of one embodiment of the invention. It includes a central train control network 10, a plurality of wayside controllers 20, and onboard systems 30 onboard the many trains.

Figure 2:
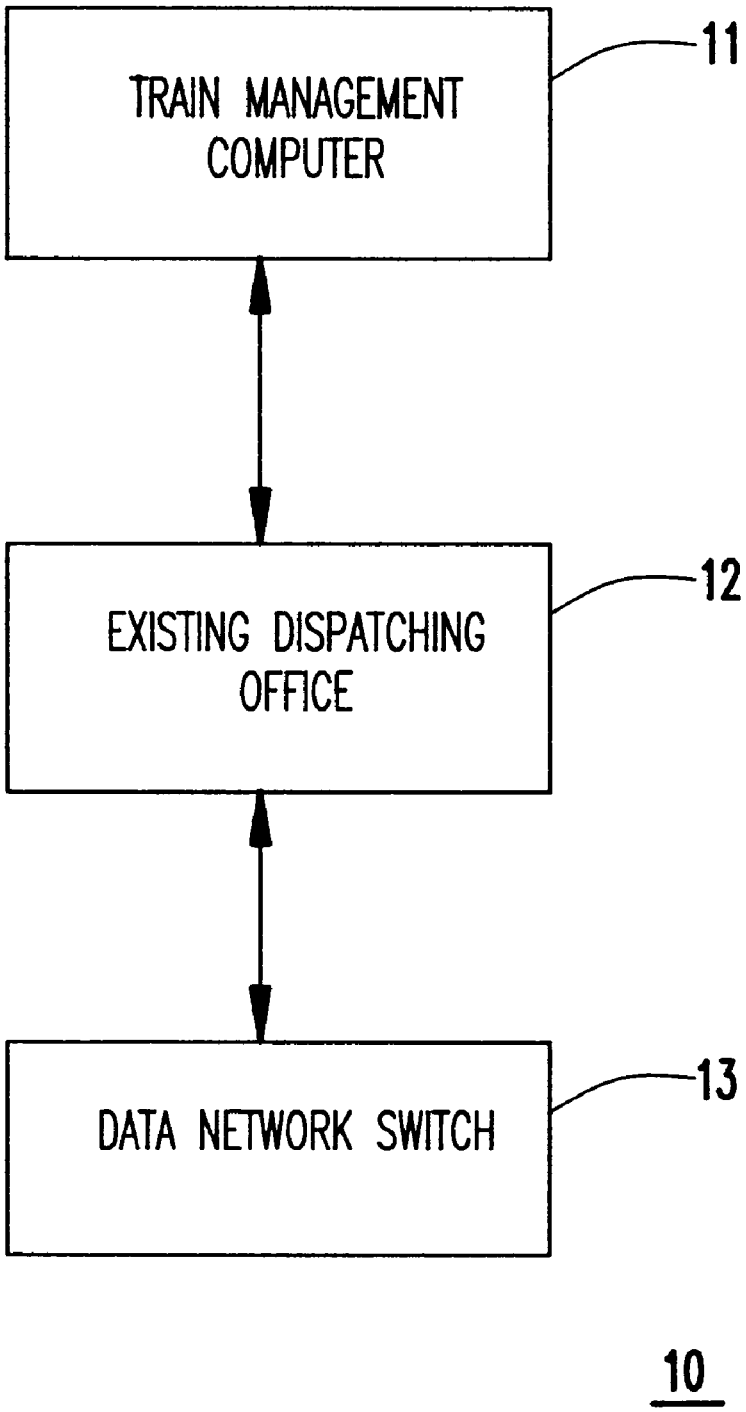
FIG. 2 is a block diagram of one embodiment of the central train control network.

FIG. 2 is a block diagram of one embodiment of the central train control network 10. It includes the existing dispatching office 12, a data network switch 13, and optionally a new train management computer 11. A dispatcher can generate movement authority (MA) as is currently done. Conflict checking of the MA's can continue to be performed within the existing dispatching office computer (i.e., checking that two trains are not given conflicting MA's). In the illustrated embodiment, a deconflicted MA (together with a train identification) is sent, in current format, to the data network switch 13 for routing to the appropriate wayside controllers 20 for execution. While a dispatcher continues to read MA's to non-equipped trains via a conventional voice radio system, the dispatching office 12 digitizes MA's for equipped trains in some embodiments of the present invention.

A block release report refers to an indication that a train has completed its transit of a portion of track. Currently, a dispatcher manually enters block release reports and may continue to do so. In some embodiments of the present invention, the data network switch 13 permits position reports and block release reports to be forwarded to the dispatching office 12 from the wayside controllers 20. Optionally, the dispatching office 12 may forward these reports to a traffic planner for dynamic railroad traffic planning.

A new train management computer 11 is not necessary for all embodiments of the present invention. However, such capabilities, which would automate and enhance train management, are compatible with the distributed architecture of the present invention, and are contemplated as part of some embodiments of the present invention.

Figure 3:
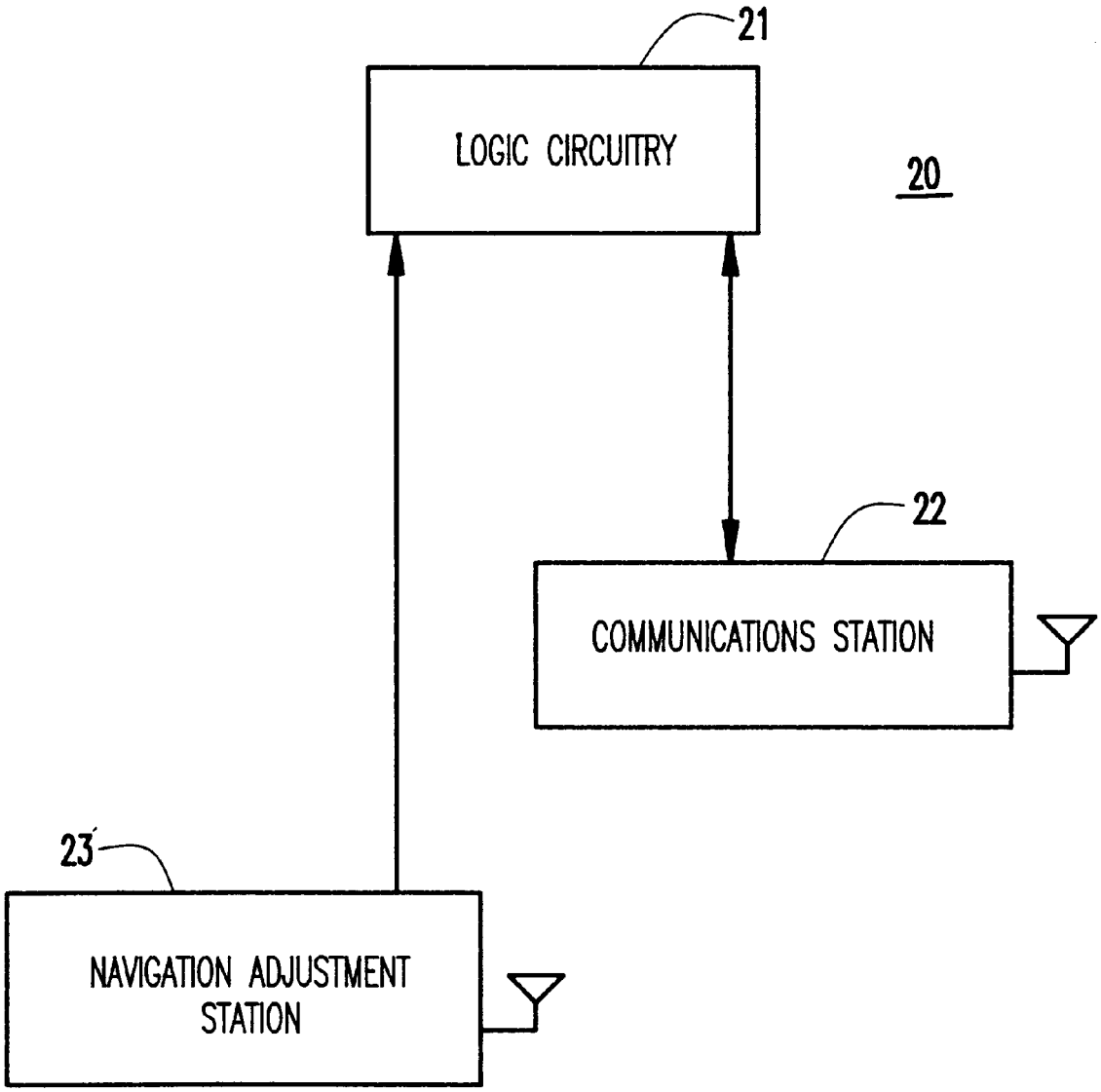
FIG. 3 is a block diagram of one embodiment of a wayside controller.

FIG. 3 is a block diagram of one embodiment of a wayside controller 20. It includes logic circuitry 21, a communications station 22, and optionally a navigation adjustment station 23. In general, a wayside controller 20 of the illustrated embodiment of FIG. 3 performs multiple functions including electronic track circuit emulation, possibly in software, based on position reports received directly from trains and on digitized movement authorities currently generated in the dispatching office. A designated section of the track network may be assigned to each wayside controller 20. An MA that spans parts of more than one such designated section of the track network may be transmitted to all applicable wayside controllers 20.

Each designated section of the track network may be divided into blocks. In some embodiments, the logic circuitry 21 contains a data base of the definition of the blocks in the designated section of the track network for that wayside controller 20. For example, a block definition may be the end coordinates of the block, the length of the block, speed limits and distances to speed limit boundaries. In some embodiments, the logic circuitry 21 partitions an MA movement authority into incremental authorities which are not necessarily executed immediately. That is, each incremental authority is executed automatically at an appropriate time. In some embodiments, the data network switch 13 coordinates the transition of incremental authority execution from one wayside controller 20 to another, when the MA spans parts of more than one designated section of the track network.

Some examples of possible functions of the logic circuitry 21 include confirming that there are no conflicting switch settings (both monitored manual switches and remote powered switches), and confirming that there are no conflicting train position reports, prior to executing an incremental authority. As another example, an MA could have conditions associated with parts of it (e.g., a train should not proceed beyond a particular siding until after two other trains pass a certain point). In some embodiments, the logic circuitry 21 does not execute the applicable incremental authority until the conditions are satisfied (e.g., no incremental movement authority into the block beyond that siding until the two trains have passed). Performance of this function by the logic circuitry 21 is more reliable than sending conditional movement authority directly to the train, and more efficient than delaying an entire MA until satisfaction of the condition. Thus, this function enhances the vitality of the overall train control system.

In short, some possible functions of a wayside controller 20 in some embodiments are: receiving MA's from the data network switch 13; receiving position reports from onboard systems 30; correlating train position reports to specific blocks; partitioning MA's into incremental authorities; confirming correct switch alignment, the absence of conflicting position reports, and the satisfaction of conditions; and executing incremental authority to enter certain blocks within certain speed limits, incrementally adding blocks until exhaustion of the movement authority. In one embodiment, the data network switch 13 automatically coordinates handing off a train to an adjacent wayside controller 20. Optionally, a wayside controller 20 may send block release reports to the data network switch 13.

In the example of FIG. 3, the communications station 22 can receive information, such as train position reports from onboard systems 30 and optionally switch position reports, which it provides to the logic circuitry 21. The communications station 22 also receives information from the logic circuitry 21, such as incremental movement authorities which the communications station 22 can transmit to onboard systems 30.

An optional feature in some embodiments of the wayside controller 20 is a navigation adjustment station 23 to provide navigation adjustment factors to the logic circuitry 21. These factors can be used to adjust the train position information which the wayside controller 20 receives from the onboard system 30. For example, such factors can be used to adjust for known local geographic aberrations of the navigation signals or for systemic deviations of the navigation system. An example of systemic deviations is selective availability error, which refers to intentional degradation of some commercially available navigation signals.

Figure 4:
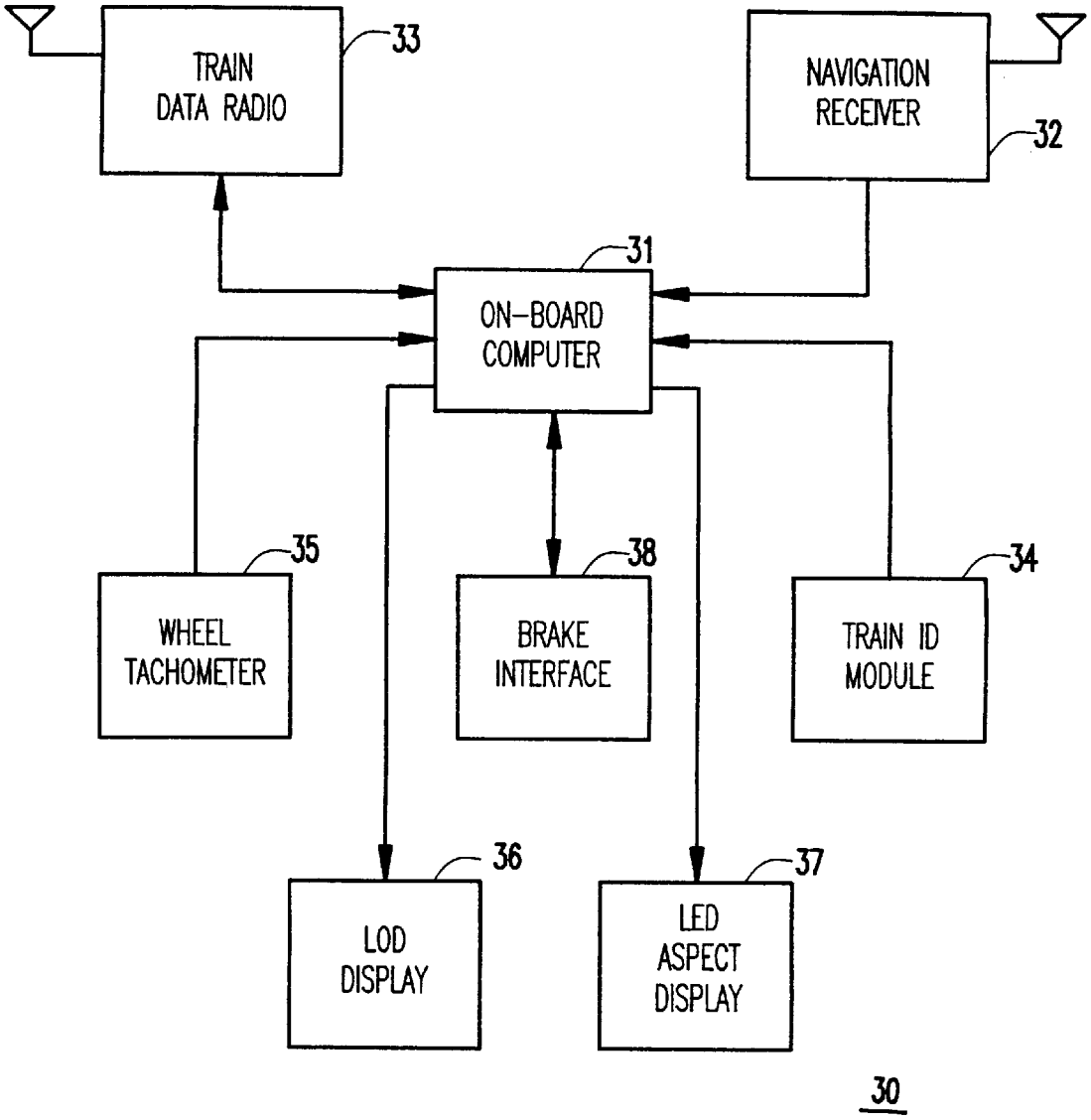
FIG. 4 is a block diagram of one embodiment of an onboard system.

FIG. 4 is a block diagram of one embodiment of an onboard system 30. The example of FIG. 4 includes an onboard computer (OBC) 31, a navigation receiver 32, a train data radio 33, a train identification module 34, a wheel tachometer 35, a liquid crystal display (LCD) 36, a light emitting diode (LED) aspect display 37, and a brake interface 38. FIG. 4 illustrates one embodiment of an onboard system 30, and other embodiments can have different components. For example, FIG. 4 includes an LCD 36 and an LED display 37, but other embodiments can use other known types of displays.

In the example of FIG. 4, a navigation receiver 32 receives signals from an independent navigation system such as GPS. It is well known how to determine location by tracking incoming signals from such an independent navigation system. In the example of FIG. 4, information from the navigation signals is provided to the OBC 31, and is incorporated into a train position report transmitted by the train data radio 33 to the communications stations 22 of local wayside controllers 20.

In the example of FIG. 4, a train identification module 34 provides train identification to the OBC 31, which information also is incorporated into the train position report transmitted by the train data radio 33. In the example of FIG. 4, a wheel tachometer 35 also provides information to the OBC 31 from which train speed may be calculated. In some embodiments, a dead reckoning distance travelled may be estimated by the OBC 31, based on information derived from the wheel tachometer 35, and the distance travelled also may be transmitted by the train data radio 33 to the wayside controllers 20. In some embodiments, the OBC 31 also may automatically generate block release reports, which would be transmitted by the train data radio 33 to the wayside controllers 20.

In the example of FIG. 4, the train data radio 33 receives information such as incremental movement authority including speed limits from the communications station 22 of a local wayside controller 20, and provides that information to the OBC 31. In the example of FIG. 4, the onboard system 30 has two independent display devices which receive information from the OBC 31.

One of the display devices in the example of FIG. 4 is a color LED aspect display 37. In some embodiments, the OBC 31 can translate the incremental authorities including speed limits into equivalent signal aspects. This makes operation in signaled and non-signaled territory nearly identical to the train engineer.

The other display device in the example of FIG. 4 is a monochrome LCD 36 that can display the text form of the MA and continuously indicate the current "Distance to Travel" to the end of the most recent incremental authority received. (In some embodiments, the OBC 31 can determine the "distance to travel" from information received from a wayside controller 20, and optionally from additional information received from the wheel tachometer 35.) The distance indications decrement as the train travels until the next incremental authority is received by the onboard system 30. If the next incremental authority does not arrive, the train engineer knows the distance to stop. In some embodiments, the LCD 36 also displays the current speed limit, the next speed limit, and the current distance to the next speed limit change.

In some embodiments, the LCD 36 also displays pending brake warnings. Thus, in the event that the train engineer is not controlling the speed of the train in accordance with the LED aspect display 37 and the LCD informational display 36, the OBC 31 generates a pending brake warning. If the train still is not brought under proper control, the brake interface 38 automatically applies train brakes prior to violation of the incremental authority including speed restrictions.

Braking calculations depend on the train consist summary or a default consist. The consist summary reflects the number of cars in the train and the weight distribution along the train. In some embodiments, this information is communicated to the central train control network 10 as trains are formed and as their composition is changed. In some embodiments, this information is communicated from the central train control network 10 to the wayside controllers 20, and from the wayside controllers 20 to the onboard systems 30. In some embodiments, this information is incorporated into the distances and speed restrictions in the incremental authorities issued by the wayside controllers 20.

Currently used train speed limiting systems operate on a worst case train dynamics basis. That is, the longest and heaviest train is always assumed. This same approach can be utilized by the OBC 31 and the brake interface 38 in some embodiments of the present invention. However, a much more productive braking algorithm is implemented in other embodiments by making minor enhancements without the need for elegant data collection. For example, freight trains may be categorized by the types currently listed in timetables, or by weight ranges such as under 10,000 tons or under 5000 tons. In one embodiment, these simple categories are entered by the train crew on a simple display as part of a train initialization process. While still satisfying safety concerns, braking enforcement is more efficient in terms of not stopping a train long before the end of a block.

In some embodiments, more sophisticated braking algorithms are implemented, using a dynamic train consist which is adjusted as the train moves from destination to destination. For example, train cars may be added or dropped, and the weight distribution may change as freight is loaded or unloaded.

Some embodiments of the present invention also can be applied in signaled territory. Currently in signaled territory, a dispatcher sends CTC movement authority to wayside CTC logic equipment (instead of reading an MA to the train engineer as in non-signaled territory). In current systems, the CTC is reflected in trackside signal aspects, and in hardware codes resulting in DC pulses on the rails. The trains pick up and decode the pulses from the rails, and the local signal aspect is reflected by in-cab signal equipment. In current systems, conflicting train positions are detected in part by electric circuits which use the train as a short between the two rails.

In some embodiments of the present invention, the wayside controllers 20 in signaled territory contain the same data base of block definitions as in non-signaled territory, and receive vital signal aspect and switch position information from existing wayside CTC logic. In some embodiments, the wayside controllers 20 receive train position information generated by existing track sensing circuitry—even for unequipped trains. The wayside controllers 20 perform electronic track circuit emulation based on the signal aspect information from the existing CTC logic and the train position information from the onboard systems 30. The wayside controllers 20 can confirm the absence of conflicting train position reports. Block definition and the preceding block signal aspect are transmitted to a train for display and enforcement as is done in non-signaled territory.

There are advantages to using the present invention instead of existing in-cab signal systems in signaled territory. For example, the present invention also may be used in non-signaled territory. The dispatcher and the train engineer continue to interact with the system as they currently do, and the current system can continue to operate for unequipped trains. In some embodiments, the present invention can accommodate any number of future signal aspects without any hardware changes at the wayside, and there is no need for coded track circuit equipment. In addition, the signal aspect is transmitted from the communications stations 22 to the train data radios 33, so transmission is assured—eliminating current problems resulting from interference between highway crossing motion sensors and the in-cab signal equipment. In some embodiments, the absence of conflicting train positions is confirmed prior to transmission of the signal aspect, without reliance on current track sensing circuits which are highly susceptible to interference.

In general, the distributed architecture of the present invention permits automatic local consideration of the many essential details necessary to coordinate train control. This enhances safety by not relying solely on individual train engineers to make those considerations, while relieving the central train control network 10 of checking those many local considerations before generating any movement authority. This permits more refined train control which leads to more efficient use of the track network, without requirements for extensive new equipment onboard each train or for very expensive new central computer capabilities.

The embodiments discussed and/or shown in the figures are examples of this distributed positive train control system. These examples are not exclusive ways to practice the present invention, and it should be understood that there is no intent to limit the invention by such disclosure. Rather, it is intended to cover all modifications and alternative constructions and embodiments that fall within the spirit and the scope of the invention as defined in the following claims.

What is claimed is:

1. A system for controlling movement of a train in a track network, the system comprising:

a central train control network;

a plurality of wayside controllers, each said wayside controller adapted to interface with the central train control network, and adapted to issue incremental movement authority to the train, wherein each said wayside controller issues incremental movement authority for only a designated section of said track network;

a data network switch coordinating a transition of the incremental movement authority between adjacent said wayside controllers when the incremental movement authority spans parts of more than one said designated section of said track network; and a train data radio adapted to transmit train position information from the train to at least one of the wayside controllers.

2. A system for controlling movement of a train as set forth in claim 1, further comprising circuitry for deriving the train position information from a navigation system.

3. A system for controlling movement of a train as set forth in claim 1, wherein the central train control network is adapted to generate movement authority for the train; and one of the wayside controllers is adapted to partition the movement authority into the incremental movement authority.

4. A system for controlling movement of a train as set forth in claim 1, wherein the central train control network is adapted to generate movement authority for the train, a part of said movement authority being effective only upon satisfaction of a condition; the system further comprising circuitry in each of the wayside controllers to prevent execution of said part of the movement authority until satisfaction of said condition.

5. A system for controlling movement of a train as set forth in claim 1, the designated section of the track network for which each of the wayside controllers issue incremental movement authority being divided into blocks; the system further comprising a data base in each said wayside controller, the data base in each said wayside controller comprising definitions of the blocks corresponding with the designated section of the track network for which said wayside controller issues incremental movement authority, the definitions comprising end coordinates of the blocks, lengths of the blocks, and speed limits within the blocks.

6. A system for controlling movement of a train as set forth in claim 5, wherein the incremental movement authority comprises permission to move to an end of a specific block at a speed not exceeding a specific limit.

7. A system for controlling movement of a train as set forth in claim 5, further comprising circuitry in each of the wayside controllers adapted to generate a block release to report to the central train control network as the train completes transit of each of the blocks.

8. A system for controlling movement of a train as set forth in claim 1, further comprising circuitry in each one of the wayside controllers adapted to confirm the absence of conflicting switch settings and the absence of conflicting train position information from other trains, prior to said one of the wayside controllers issuing the incremental movement authority.

9. A system for controlling movement of a train as set forth in claim 1, each wayside controller being adapted to receive signal aspect information for the respective designated section of the track network for which each said wayside controller issues the incremental movement authority, each said wayside controller further comprising:

logic circuitry adapted to select a signal aspect, from the among signal aspect information, which said signal aspect corresponds with the train position information; and a communications station adapted to receive the train position information from the train, and of transmitting said signal aspect to the train.

10. A system for controlling movement of a train as set forth in claim 1, further comprising a display in the train, the display indicating at least one of: a current speed limit, a next speed limit, a current distance until a next speed limit change, a current distance left to travel within the current incremental movement authority, and a pending brake warning.

11. A system for controlling movement of a train as set forth in claim 1, further comprising a display in the train, the display indicating a current signal aspect.

12. A system for controlling movement of a train as set forth in claim 1, wherein said plurality of wayside controllers confirm that there are no conflicting switch settings in the track network prior to executing the incremental movement authority.

13. A system for controlling movement of a train as set forth in claim 1, wherein said data network switch automatically coordinates handing off a train to the adjacent wayside controller when the incremental movement authority spans parts of more than one said designated section of said track network.

14. A system for controlling movement of a train in a track network, the system comprising:

means for transmitting train position information from the train to at least one of a plurality of wayside controllers;

means for interfacing between the wayside controllers and a central train control network;

means for issuing incremental movement authority from one of the wayside controllers to the train, wherein each of the wayside controllers issues incremental movement authority for only a designated section of the track network; and means for coordinating a transition of the incremental movement authority from one of said wayside controllers to another of said wayside controllers when the incremental movement authority spans parts of more than one said designated section of said track network.

15. A system for controlling movement of a train as set forth in claim 14, further comprising means for deriving the train position information from a navigation system.

16. A system for controlling movement of a train as set forth in claim 14, further comprising:

means for generating movement authority for the train by the central train control network; and means for partitioning the movement authority into the incremental movement authority by at least one of the wayside controllers.

17. A system for controlling movement of a train as set forth in claim 14, further comprising means for the one of the wayside controllers to confirm the absence of conflicting switch settings and the absence of conflicting train position information from other trains, prior to issuing the incremental movement authority.

18. A method for controlling movement of a train in a track network, the method comprising:

transmitting train position information from the train to at least one of a plurality of wayside controllers;

interfacing between the wayside controllers and a central train control network;

issuing incremental movement authority from one of the wayside controllers to the train, wherein each of the wayside controllers issues incremental movement authority for only a designated section of the track network; and coordinating a transition of the incremental movement authority between adjacent wayside controllers when the incremental movement authority spans parts of more than one said designated section of said track network.

19. A method for controlling movement of a train as set forth in claim 18, wherein the train position information is derived from a navigation system.

20. A method for controlling movement of a train as set forth in claim 19, further comprising the step of adjusting the train position information to correct for known deviations of the navigation system.

21. A method for controlling movement of a train as set forth in claim 18, further comprising the steps of:

generating movement authority for the train by the central train control network; and partitioning the movement authority into the incremental movement authority by at least one of the wayside controllers.

22. A method for controlling movement of a train as set forth in claim 18, further comprising the step of generating movement authority for the train by the central train control network; wherein at least a part of the movement authority is effective only upon satisfaction of a condition; and wherein the issuing step is not executed by the one of the wayside controllers for said part of the movement authority until satisfaction of said condition.

23. A method for controlling movement of a train as set forth in claim 18 further comprising the steps by the central train control network of:

generating movement authority for the train; and coordinating transition of the issuing step from one to another of the wayside controllers, when the movement authority overlaps the designated sections of more than a single wayside controller.

24. A method for controlling movement of a train as set forth in claim 18, further comprising the step of at least one of the wayside controllers containing a data base of definitions of blocks, the designated section of the track network for which said at least one wayside controller issues incremental movement authority being divided into said blocks, the definitions comprising end coordinates of the blocks, lengths of the blocks, and speed limits within the blocks.

25. A method for controlling movement of a train as set forth in claim 24, therein the incremental movement authority comprises permission to move to an end of a specific block at a speed not exceeding a specific limit.

26. A method for controlling movement of a train as set forth in claim 24, Further comprising the step of the at least one wayside controller sending a block release to the central train control network to report as the train completes transit of each of the blocks.

27. A method for controlling movement of a train as set forth in claim 18, further comprising the step of braking automatically if the train exceeds the incremental movement authority.

28. A method for controlling movement of a train as set forth in claim 18, further comprising the step of the one of the wayside controllers confirming the absence of conflicting switch settings and the absence of conflicting train position information from other trains, prior to executing the issuing step.

29. A method for controlling movement of a train as set forth in claim 18, further comprising the steps of the one of the wayside controllers:

receiving signal aspect information for the designated section of the track network;

selecting a signal aspect, from the signal aspect information, which corresponds with the train position information; and transmitting said signal aspect to the train.

30. A method for controlling movement of a train as set forth in claim 18, further comprising the steps of:

receiving a train consist summary; and modifying train braking requirements based on the train consist summary.

31. A method for controlling movement of a train as set forth in claim 18, further comprising the step of displaying in the train at least one of: a current speed limit, a next speed limit, a current distance until a next speed limit change, a current distance left to travel within the current incremental movement authority, and a pending brake warning.

32. A method for controlling movement of a train as set forth in claim 18 further comprising the step of displaying in the train a current signal aspect.

* * * * *